US010525489B2

(12) United States Patent
Steiner et al.

(10) Patent No.: US 10,525,489 B2
(45) Date of Patent: Jan. 7, 2020

(54) AUTOMATED SPRAYER ASSEMBLY

(71) Applicant: HONDA MOTOR CO., LTD., Tokyo (JP)

(72) Inventors: Michael R. Steiner, New Bremen, OH (US); Michael J. Hochstetler, Jr., Sidney, OH (US); Jerry A. Lucas, New Bremen, OH (US); Donald Rethman, Jackson Center, OH (US)

(73) Assignee: Honda Motor Co., Ltd., Tokyo (JP)

( * ) Notice: Subject to any disclaimer, the term of this patent is extended or adjusted under 35 U.S.C. 154(b) by 261 days.

(21) Appl. No.: 14/206,317

(22) Filed: Mar. 12, 2014

(65) Prior Publication Data

US 2014/0263752 A1 Sep. 18, 2014

Related U.S. Application Data

(60) Provisional application No. 61/790,756, filed on Mar. 15, 2013.

(51) Int. Cl.

| | |
|---|---|
| ***B05B 7/04*** | (2006.01) |
| ***B05B 13/02*** | (2006.01) |
| ***B05B 13/04*** | (2006.01) |

(52) U.S. Cl.

CPC ..... *B05B 7/0416* (2013.01); *B05B 13/0278* (2013.01); *B05B 13/0431* (2013.01)

(58) Field of Classification Search

CPC .. B05B 1/14; B05B 1/185; B05B 1/02; B05B 1/169; B05B 7/32; B05B 7/0408; B05B 12/1409; B05B 12/1418; B05B 7/0416; B05B 7/0483; B05B 13/0278; B05B 13/0431

USPC ..... 239/556, 557, 560, 562, 565, 398, 407, 239/412, 413

See application file for complete search history.

(56) References Cited

U.S. PATENT DOCUMENTS

| | | | | | |
|---|---|---|---|---|---|
| 507,581 | A * | 10/1893 | Giesler | B05B 7/0408 | 239/428 |
| 4,293,024 | A * | 10/1981 | Kikuchi | B22D 17/2007 | 164/267 |
| 4,699,587 | A * | 10/1987 | Shimoda | F23D 11/102 | 239/427 |
| 4,739,933 | A * | 4/1988 | Hanano | B29C 33/58 | 239/304 |
| 4,760,961 | A | 8/1988 | Nagai | | |
| 5,143,297 | A * | 9/1992 | De Michele | B05B 7/0475 | 239/427 |
| 5,638,893 | A * | 6/1997 | Sankaran | B05B 15/0406 | 164/268 |
| 5,878,960 | A | 3/1999 | McInerney, II et al. | | |
| 6,601,741 | B2 * | 8/2003 | McGuffey | B05C 5/0279 | 137/884 |
| 6,739,526 | B2 * | 5/2004 | Wlodarczyk | B05B 7/0876 | 118/302 |
| 6,830,200 | B1 * | 12/2004 | Jordan | B22D 17/2007 | 164/72 |
| 7,082,262 | B2 * | 7/2006 | Clark | B05B 7/0861 | 222/146.2 |

(Continued)

FOREIGN PATENT DOCUMENTS

CN 201880649 U 6/2011

*Primary Examiner* — Jason J Boeckmann

(74) *Attorney, Agent, or Firm* — Armstrong Teasdale LLP

(57) ABSTRACT

A sprayer head includes a platen manifold and a plurality of nozzles fluidly coupled with the platen manifold. A sprayer assembly is also provided.

20 Claims, 18 Drawing Sheets

(56) References Cited

U.S. PATENT DOCUMENTS

| | | | | |
|---|---|---|---|---|
| 7,156,144 | B2 | 1/2007 | Erhard et al. | |
| 7,472,841 | B2 * | 1/2009 | Erhard | B05B 13/0278 239/390 |
| 7,837,131 | B2 * | 11/2010 | Huffman et al. | 239/139 |
| 8,662,192 | B2 * | 3/2014 | Dunster | A62C 99/0072 169/14 |
| 2003/0111561 | A1 * | 6/2003 | Hanano | B05B 1/14 239/548 |
| 2004/0124282 | A1 * | 7/2004 | Mansour et al. | 239/548 |
| 2007/0125888 | A1 * | 6/2007 | Zillig | B05B 7/0884 239/566 |
| 2010/0003904 | A1 * | 1/2010 | Duescher | B24B 37/14 451/259 |
| 2010/0224665 | A1 * | 9/2010 | Vinnay et al. | 226/102 |
| 2011/0100469 | A1 * | 5/2011 | Beeston | F16K 1/22 137/1 |
| 2014/0075949 | A1 * | 3/2014 | Prociw | F23R 3/346 60/740 |
| 2014/0163664 | A1 * | 6/2014 | Goldsmith | A61B 17/00491 623/1.11 |
| 2015/0297924 | A1 * | 10/2015 | Corn | A62C 35/68 169/14 |
| 2016/0096159 | A1 * | 4/2016 | Black | B01J 8/1809 239/302 |

* cited by examiner

AUTOMATED SPRAYER ASSEMBLY

REFERENCE TO RELATED APPLICATION

This application claims priority of U.S. provisional patent application Ser. No. 61/790,756, entitled AUTOMATED SPRAYER ASSEMBLY, filed Mar. 15, 2013, and hereby incorporates this provisional patent application by reference herein in its entirety.

TECHNICAL FIELD

A sprayer assembly includes a sprayer head having a manifold that is fluidly coupled with an atomizer and a plurality of nozzles for dispensing a fluid onto a die mold.

BACKGROUND

Conventionally, during a molding process, a sprayer head is provided that dispenses fluid onto a die mold either in preparation for casting a mold or once a mold has already been cast and removed. These sprayer heads are configured to be specific to a particular die mold and are thus not compatible with other die molds.

SUMMARY

In accordance with one embodiment, a sprayer assembly comprises a sprayer head, an atomizer manifold, a fluid conduit, an air conduit, and a plurality of atomizers. The sprayer head comprises a platen manifold and a plurality of nozzles fluidly coupled with the platen manifold. The fluid conduit is fluidly coupled with the atomizer manifold and is configured to supply fluid to the atomizer manifold. The air conduit is fluidly coupled with the atomizer manifold and is configured to supply air to the atomizer manifold to atomize the fluid within the atomizer manifold. The plurality of atomizers is fluidly coupled with the atomizer manifold and the platen manifold. Each atomizer is configured to feed atomized fluid to the platen manifold for dispensation of the atomized fluid from a subset of the plurality of nozzles.

In accordance with another embodiment, a sprayer assembly comprises a sprayer head, a first atomizer manifold, a second atomizer manifold, a first fluid conduit, a second fluid conduit, a first air conduit, a second air conduit, a first atomizer, a second atomizer, a third atomizer, a fourth atomizer. The sprayer head comprises a first platen manifold, a second platen manifold, a first group of nozzles, a second group of nozzles, a third group of nozzles, and a fourth group of nozzles. The first platen manifold comprises a first submanifold and a second submanifold. The second platen manifold comprises a third submanifold and a fourth submanifold. The first group of nozzles is fluidly coupled with the first submanifold. The second group of nozzles is fluidly coupled with the second submanifold. The third group of nozzles is fluidly coupled with the third submanifold. The fourth group of nozzles is fluidly coupled with the fourth submanifold. The first fluid conduit is fluidly coupled with the first atomizer manifold and is configured to supply fluid to the first atomizer manifold. The second fluid conduit is fluidly coupled with the second atomizer manifold and is configured to supply fluid to the second atomizer manifold. The first air conduit is fluidly coupled with the first atomizer manifold and is configured to supply air to atomize the fluid within the first atomizer manifold. The second air conduit is fluidly coupled with the second atomizer manifold and is configured to supply air to atomize the fluid within the second atomizer manifold. The first atomizer is fluidly coupled with the first atomizer manifold and the first submanifold. The first atomizer is configured to feed atomized fluid to the first submanifold for dispensation from the first group of nozzles. The second atomizer is fluidly coupled with the first atomizer manifold and the second submanifold. The second atomizer is configured to feed atomized fluid to the second submanifold for dispensation from the second group of nozzles. The third atomizer is fluidly coupled with the second atomizer manifold and the third submanifold. The third atomizer is configured to feed atomized fluid to the third submanifold for dispensation from the third group of nozzles. The fourth atomizer is fluidly coupled with the second atomizer manifold and the fourth submanifold. The fourth atomizer is configured to feed atomized fluid to the fourth submanifold for dispensation from the fourth group of nozzles.

In accordance with yet another embodiment, a sprayer head comprises a first platen manifold, a second platen manifold, a first group of nozzles, a second group of nozzles, a third group of nozzles, and a fourth group of nozzles. The first platen manifold comprises a first submanifold and a second submanifold. The second platen manifold comprises a third submanifold and a fourth submanifold. The first group of nozzles is fluidly coupled with the first submanifold and is configured to facilitate dispensation of atomized fluid from the first submanifold. The second group of nozzles is fluidly coupled with the second submanifold and is configured to facilitate dispensation of atomized fluid from the second submanifold. The third group of nozzles is fluidly coupled with the third submanifold and is configured to facilitate dispensation of atomized fluid from the third submanifold. The fourth group of nozzles is fluidly coupled with the fourth submanifold and is configured to facilitate dispensation of atomized fluid from the fourth submanifold.

BRIEF DESCRIPTION OF THE DRAWINGS

It is believed that certain embodiments will be better understood from the following description taken in conjunction with the accompanying drawings in which.

DETAILED DESCRIPTION

Figure 1:
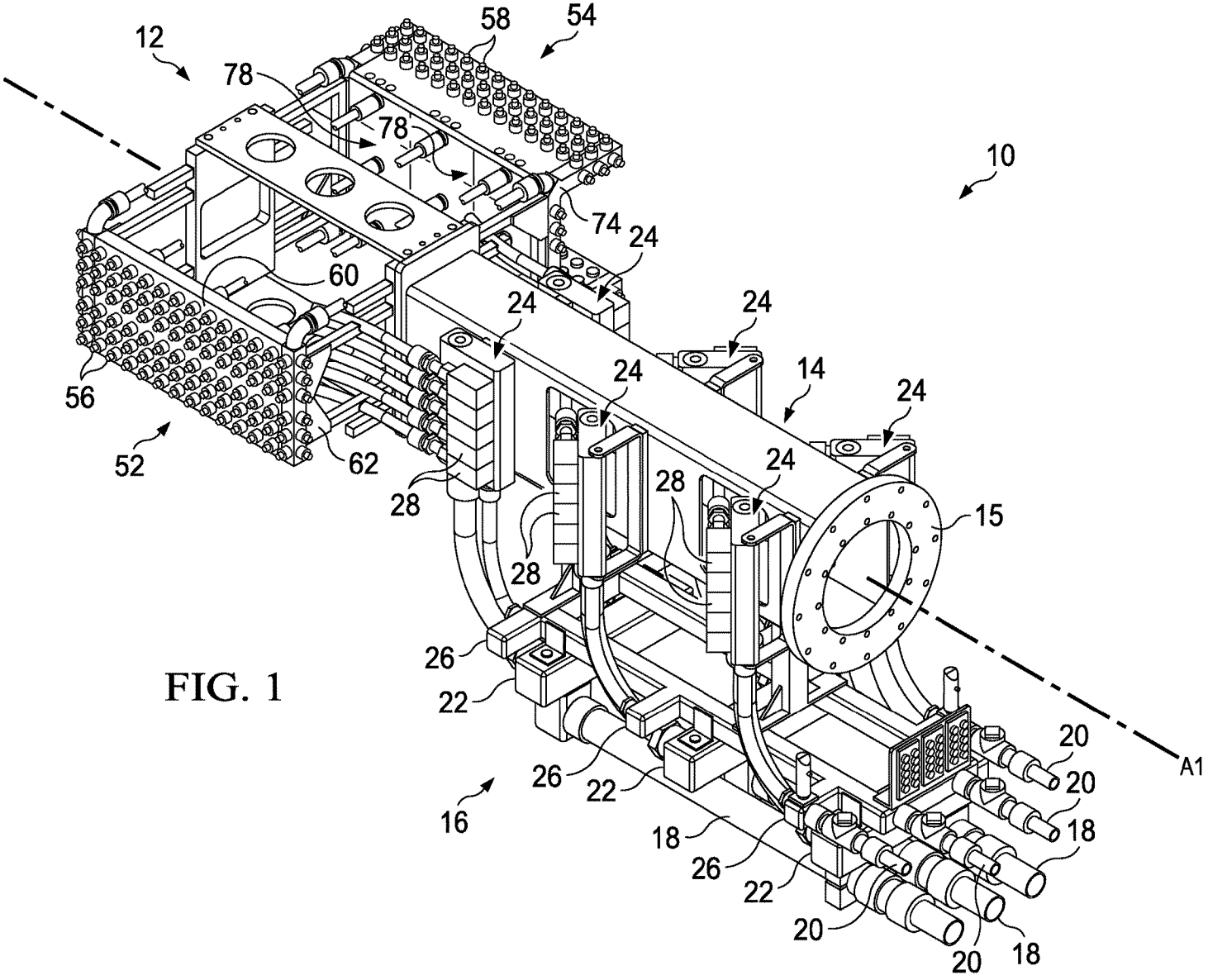
FIG. 1 is a right rear perspective view depicting an automated sprayer assembly having a sprayer head in accordance with one embodiment.

In connection with the views and examples of FIGS. 1-8, 9A-9D, 10A-10F, and 11, wherein like numbers indicate the same or corresponding elements throughout the views, FIGS. 1-4 illustrate one embodiment of a sprayer assembly 10 for an automated fluid spraying process for die molds. Generally, a casting process can utilize a die mold. The die mold can comprise a two-part mold or any of a variety of multi-part die molds. The die mold parts can be selectively mated together and can cooperate with each other to define a casting receptacle into which molten material (e.g., aluminum) can be provided. Once the molten material is provided into the die mold and then cooled, the die mold parts can be separated and the casting can be removed therefrom.

Prior to assembling the die mold parts, the sprayer assembly 10 can facilitate application of a lubricant to the die mold. The lubricant can lubricate the surface of the casting receptacle to help prevent the casting from sticking inside of the die mold. The lubricant can also serve as a coolant for the die mold and can be applied to the die mold until the temperature cools enough to allow molten material to be provided to the die mold again without causing excessive heating. As illustrated in FIGS. 1-4, the sprayer assembly 10 can include a sprayer head 12 (e.g., a spray jig or a cassette) that is attached to a frame arm 14. The frame arm 14 can be attached to a robotic apparatus (e.g., 282 shown in FIGS. 10B-10D) for use in an automated process (e.g., an assembly line-type process). In one embodiment, the frame arm 14 can include a bolt flange 15 that facilitates mounting of the sprayer assembly 10 to the robotic apparatus.

A fluid delivery system 16 can be fluidly coupled with the sprayer head 12 and configured to feed lubricant to the sprayer head 12 for dispensation onto an associated die mold. The fluid delivery system 16 can include a plurality of air supply conduits 18 and a plurality of fluid supply conduits 20. The air supply conduits 18 can be fluidly coupled with respective air splitters 22. Each of the air splitters 22 can route air from each of the air supply conduits 18 to a pair of atomizer manifolds 24. The fluid supply conduits 20 can be fluidly coupled with respective fluid splitters 26. Each of the fluid splitters 26 can route the lubricant from each of the respective fluid supply conduits 20 to respective pairs of the atomizer manifolds 24. Each atomizer manifold 24 includes a plurality of atomizers 28. Air and lubricant can mix together within the atomizer manifolds 24 and the atomizers 28 can feed atomized lubricant to the sprayer head 12 for dispensation onto a nearby die mold.

Although the fluid dispensed by the sprayer assembly 10 is described as a lubricant (e.g., a cooling lubricant), it will be appreciated that the sprayer assembly 10 can be configured to deliver any of a variety of suitable alternative fluids to a nearby die mold, such as anti-solder or water, for example. One example of the fluid delivery system 16 is provided in FIG. 5 and is shown to include a supply manifold 30 that includes a lubricant port 32, an anti-solder port 34, an air port 36, and a water port 38. The ports 32, 34, 36, 38 can each be coupled to a respective lubricant source, anti-solder source, air source, and water source. The air port 36 can be fluidly coupled with a plurality of air delivery lines 40 that are fluidly coupled with respective ones of the air supply conduits 18 for the sprayer head 12. Each of the air delivery lines 40 can be selectively fluidly coupled with the air port 36 by an air valve network 42. A valve pilot controller 44 can be electrically coupled with the air valve network 42 and can control operation of each of the valves in the air valve network 42 to control the flow of air to the atomizer manifolds 24. Each of the fluid ports 32, 34, 38 can be fluidly coupled with a plurality of fluid delivery lines 46 that are each fluidly coupled with respective ones of the fluid supply conduits 20 of the sprayer head 12. The fluid delivery lines 46 can be selectively fluidly coupled with the fluid ports 32, 34, 38 by a fluid valve network 48. The valve pilot controller 44 (or another controller) can be electrically coupled with the fluid valve network 48 and can facilitate control of each of the valves in the fluid valve network 48 to facilitate distribution of any of the fluids (e.g., lubricant, anti-solder, and/or water), or combinations thereof, to the sprayer head 12. In one embodiment, the sprayer assembly 10 can include a man-machine interface (MMI) (not shown) that permits an operator to select the type(s) of fluid that are dispensed from the sprayer head 12. In other embodiments, the fluid dispensed from the sprayer head 12 can be selected via an automated controller (e.g., 290 shown in FIGS. 10E and 10F).

Referring again to FIGS. 1-4, the sprayer head 12 can include first and second platen manifolds 52, 54 each having a plurality of first nozzles 56 and a plurality of second nozzles 58, respectively. The first and second platen manifolds 52, 54 can be provided on opposite sides of the sprayer head 12 (e.g., a left side and a right side, respectively). The first platen manifold 52 can be a substantially planar member (e.g., a plate). The first nozzles 56 can be distributed along an outer surface 60 and along two opposing end surfaces 62 of the first platen manifold 52 such that the first platen manifold 52 can distribute fluid in three substantially different directions. The second platen manifold 54 can be substantially C-shaped (see FIG. 4). The second nozzles 58 can be distributed along upper and lower exterior surfaces 64, 66, upper, lower, and central interior surfaces 68, 70, 72, and opposing end surfaces 74 of the second platen manifold 54 such that the second platen manifold 54 can distribute fluid in four substantially different exterior directions (e.g., from the second nozzles 58 disposed along the upper and lower exterior surfaces 64, 66 and the opposing end surfaces 74) and in three substantially different interior directions (e.g., from the second nozzles 58 disposed along the upper, lower, and central interior surfaces 68, 70, 72).

The arrangement of the first and second nozzles 56, 58 on the respective first and second platen manifolds 52, 54 can conform to the die mold to facilitate effective dispensation of fluid onto a die mold. In one embodiment, the die mold (e.g., 284 shown in FIGS. 10A, 10C and 10D) can include a base portion (e.g., 288 in FIGS. 10A, 10C and 10D) and a lid portion (e.g., 286 in FIGS. 10A, 10C and 10D). The base portion and the lid portion can cooperate to define a casting receptacle. The lid portion can overlie the base portion and can provide a port through which molten metal can be introduced to the die mold. In some arrangements, the base portion can define a greater portion of the casting receptacle than the lid portion. In one embodiment, the lid portion can be fixed and the base portion can move relative to the lid portion.

Referring now to the die molding process, once the base portion and the lid portion have been separated and the casting removed (e.g., manually and/or through automation), the sprayer head 12 can move into position between the base portion and lid portion with the first platen manifold 52 positioned adjacent to the lid portion and the second platen manifold 54 positioned adjacent the base portion. At least a portion of each of the first and second platen manifolds 52, 54 can extend into the lid portion and the base portion (e.g., into their respective casting receptacles), respectively. In one embodiment, with the sprayer head 12 in position, the base portion and the lid portion can be moved to sandwich the sprayer head 12 between the base portion and the lid portion such that the sprayer head 12 is almost entirely enveloped by the die mold. Once the sprayer head 12 is in position, the first and second nozzles 56, 58 can be activated to dispense atomized fluid (e.g., lubricant) into the lid portion and the base portion, respectively. Once the application of fluid is complete, the lid portion and the base portion can be moved away from the sprayer head 12 and the sprayer head 12 can be retracted into a stand-by position. The lid portion and the base portion can then be placed together for molding another casting. In one embodiment, the sprayer assembly 10 can be moved linearly (e.g., by the robotic apparatus) along a longitudinal axis (A1 in FIG. 10B). In some embodiments, the sprayer assembly 10 can additionally or alternatively be rotated about the longitudinal axis.

In one example, the configuration of the first and second platen manifolds 52, 54 can be suitable for dispensing atomized fluid onto a die mold for an inline four-cylinder engine block. In particular, the rectangular shape of the first platen manifold 52 can correspond with a relatively shallow rectangular casting receptacle defined by the lid portion. The C-shape of the second platen manifold 54 can correspond with the casting receptacle of the base portion which can include a row of projections that create four cylinder bores into the engine block casting. When the second platen manifold 54 is inserted into the casting receptacle of the base portion, the second platen manifold 54 can straddle the projections to facilitate effective distribution of atomized fluid throughout the casting receptacle of the base portion. It will be appreciated that the shape and configuration of the first and second platen manifolds 52, 54 shown in FIGS. 1-4 can be compact and diverse enough for use in any of a variety of different die molds. In addition, movement of the sprayer assembly 10 along the longitudinal axis can allow the sprayer head 12 to be moved with respect to a die mold in order to conform to different die mold shapes and sizes. It will also be appreciated that, in some embodiments, the first and second platen manifolds 52, 54 can be configured in any of a variety of sizes and shapes to correspond with a particular die mold.

Figure 3:
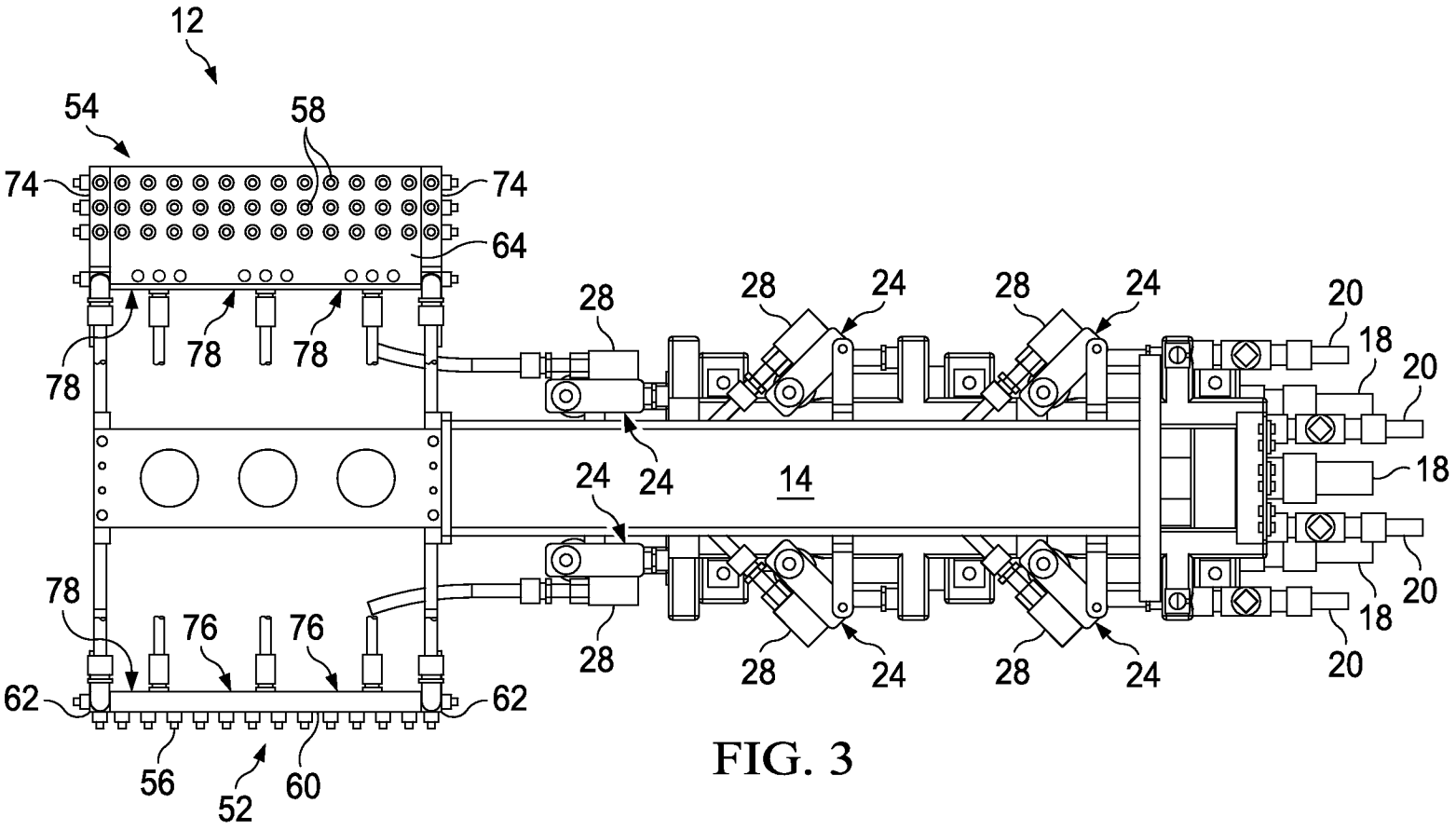
FIG. 3 is a top perspective view of the automated sprayer assembly of FIG. 1.
Figure 4:
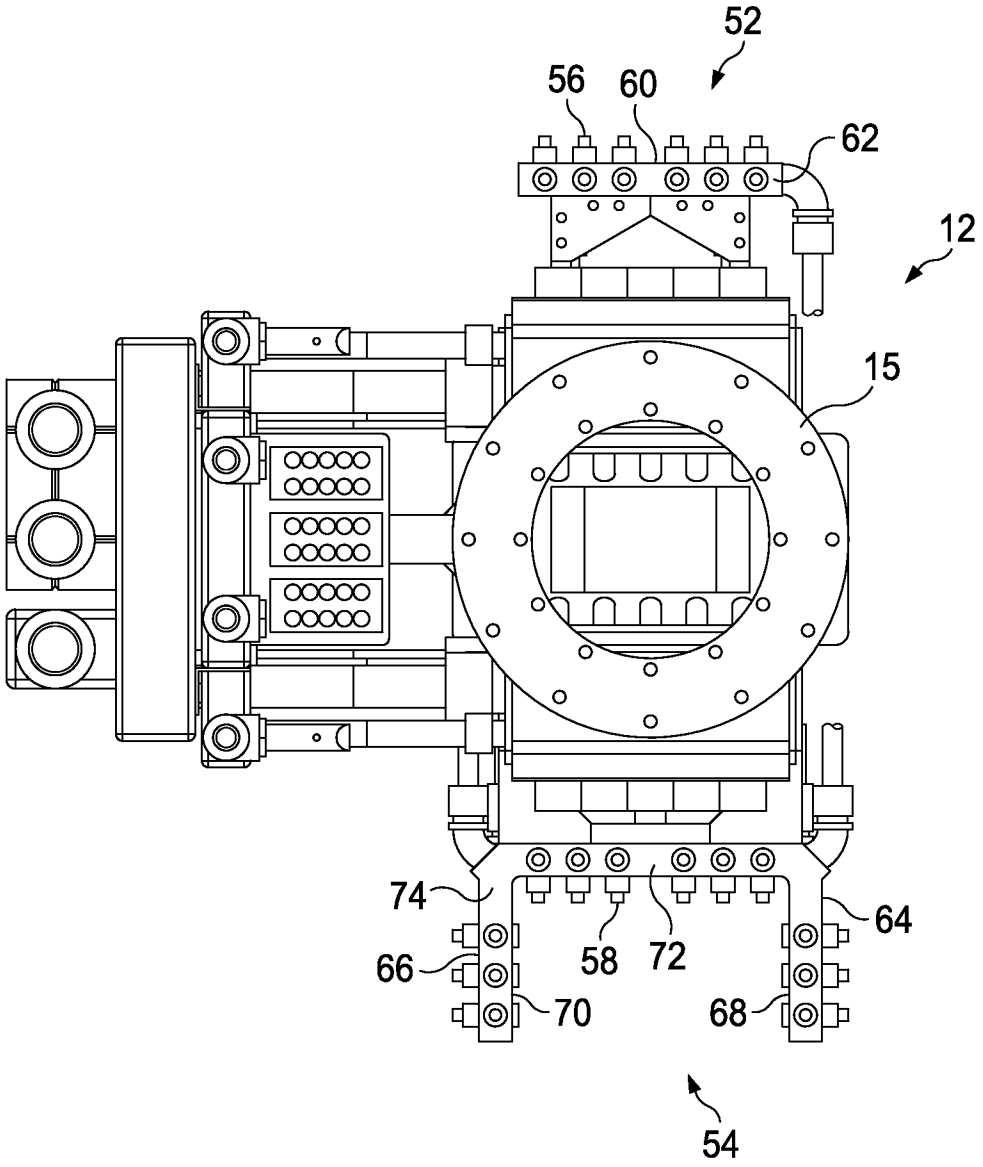
FIG. 4 is a rear perspective view of the automated sprayer assembly of FIG. 1.
Figure 5:
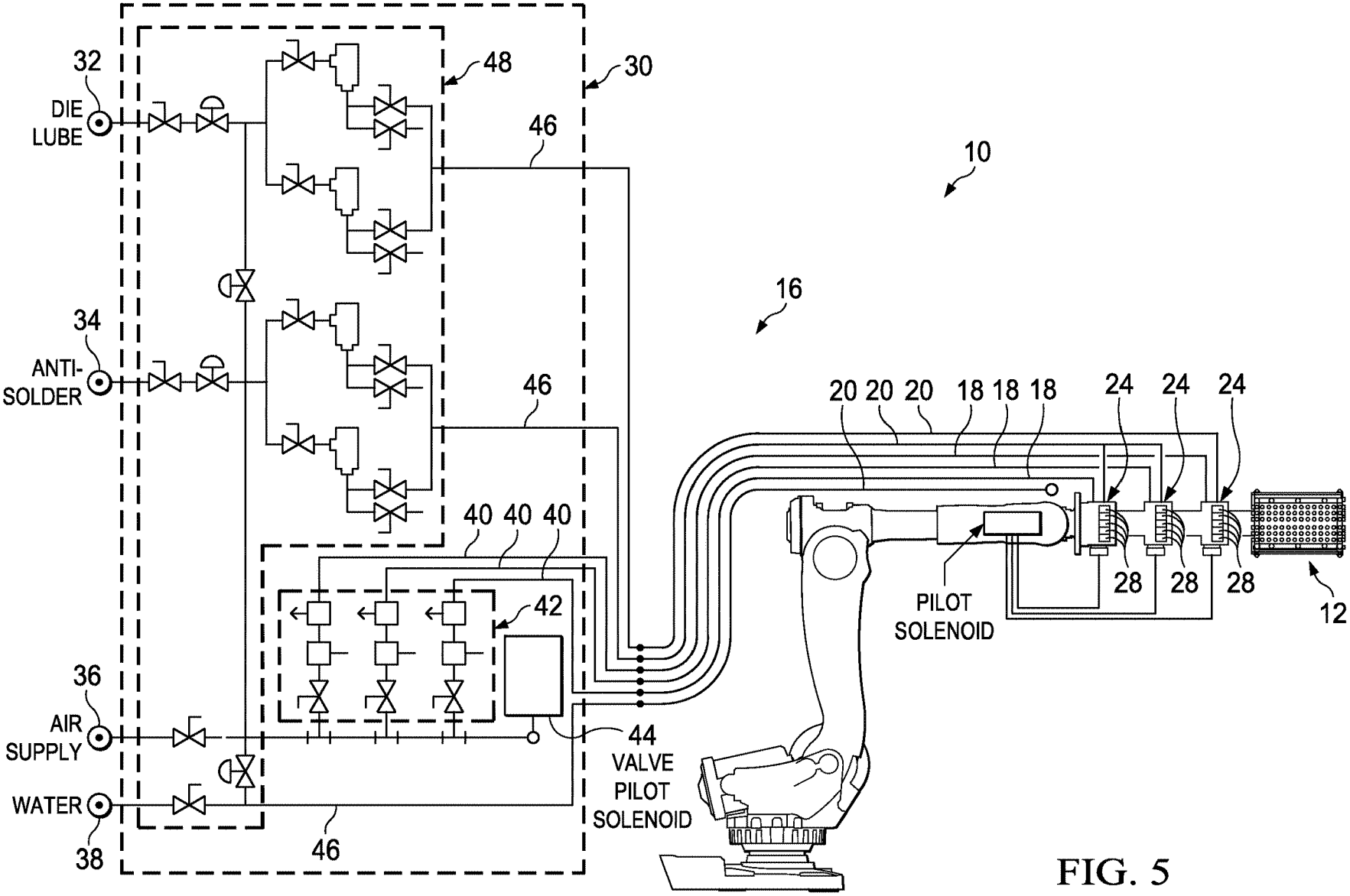
FIG. 5 is a schematic view depicting a fluid delivery system associated with the sprayer head of FIG. 1.
Figure 6:
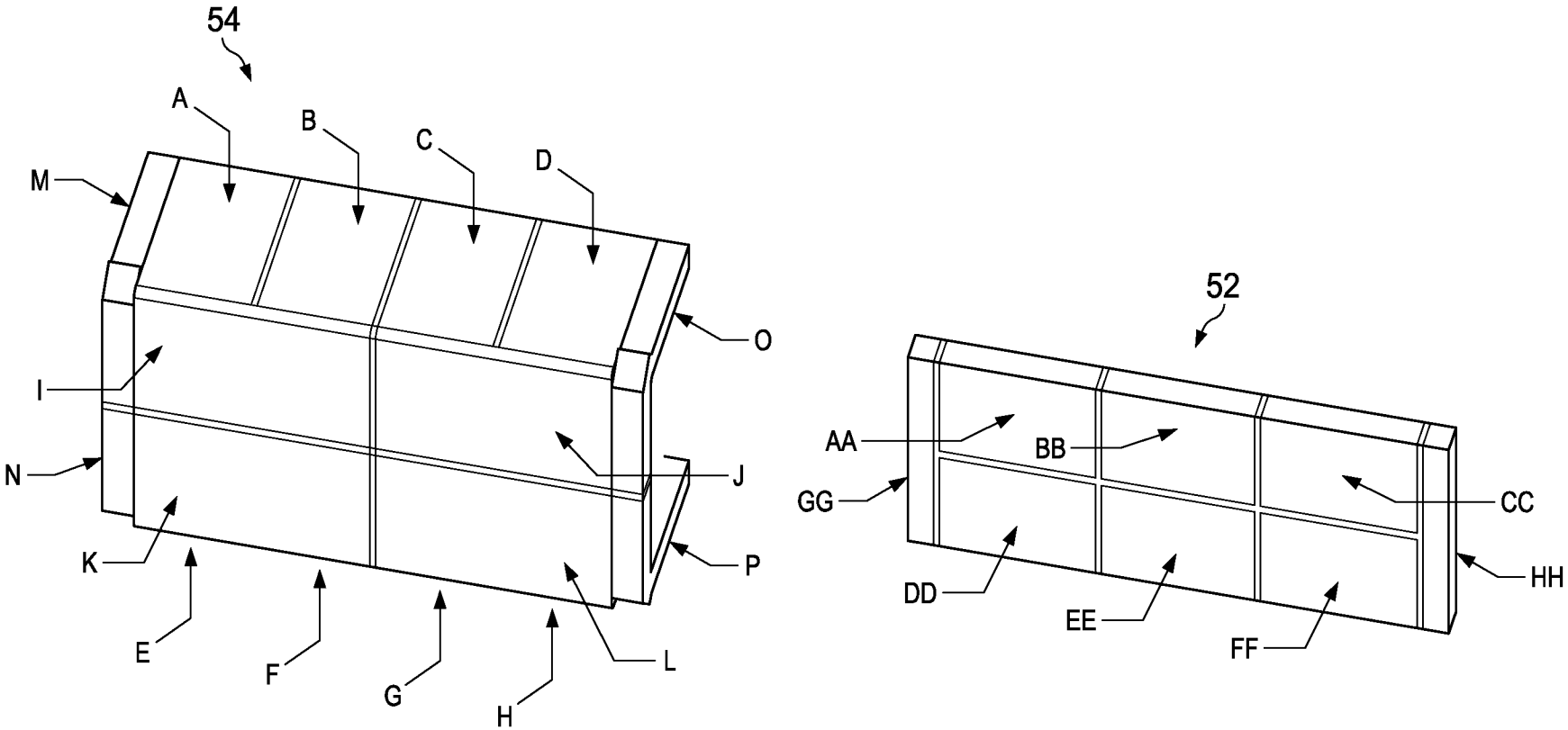
FIG. 6 is a schematic view depicting various zones of nozzles of the sprayer head of FIG. 1.

Each of the first and second platen manifolds 52, 54 can include respective pluralities of first and second sub-manifolds (e.g., 76, 78 in FIGS. 1 and 3, respectively). Each of the first and second sub-manifolds (e.g., 76, 78) can be fluidly coupled with a respective group of the first and second nozzles 56, 58, respectively. Each group of nozzles (e.g., 56, 58) can define a different spray zone along the first and second platen manifolds 52, 54. In one embodiment, each spray zone can comprise between about six and about nine nozzles. FIG. 6 illustrates one example of the different spray zones of the first and second platen manifolds 52, 54. The nozzles (e.g., 56, 58 in FIGS. 3 and 4) that define each spray zone can be fluidly coupled with one of the sub-manifolds (e.g., 76, 78 in FIG. 3) such that the nozzles (e.g., 56, 58) in each zone are fed by one sub-manifold (e.g., 76, 78). As illustrated in FIG. 6, the first platen manifold 52 can have eight different spray zones (AA, BB, CC, DD, EE, FF, GG, and HH). Six of the spray zones (AA-FF) can be substantially square-shaped and can each be comprised of a different group of first nozzles (e.g., 56) that are provided along the outer surface (e.g., 60 in FIG. 4) of the first platen manifold 52. The remaining two zones (GG and HH) can be substantially rectangular shaped and can each be comprised of the respective groups of first nozzles (e.g., 56) located at the opposing end surfaces (e.g., 62 in FIGS. 3 and 4). The second platen manifold 54 can have sixteen different spray zones (A, B, C, D, E, F, G, H, I, J, K, L, M, N, O, P). Four of the spray zones (A-D) are shown to be provided along an upper portion of the second platen manifold 54. Each of these spray zones can be substantially square-shaped and can each be comprised of a different group of second nozzles (e.g., 58) that are provided along the upper exterior surface (e.g., 64 in FIG. 4) and the upper interior surface (e.g., 68 in FIG. 4). Four of the spray zones (E-H) are shown to be provided along a lower portion of the second platen manifold 54. Each of these spray zones can be substantially square-shaped and can each be comprised of a different group of second nozzles (e.g., 58) that are provided along the lower exterior surface (e.g., 66 in FIG. 4) and the lower interior surface (e.g., 70 in FIG. 4). Another four spray zones (I-L) are shown to be provided along a central portion of the second platen manifold 54. Each of these spray zones can be substantially rectangular-shaped and can each be comprised of a different group of second nozzles (e.g., 58) that are provided along the central interior surface (e.g., 72 in FIG. 4). The remaining four spray zones (M-P) are shown to be substantially L-shaped and can each be comprised of a different group of second nozzles 58 that are disposed at the two opposing end surfaces (e.g., 74 in FIG. 4). It will be appreciated that a sprayer head can be provided with any of a variety of different zone arrangements which can be defined by any of a variety of different nozzle quantities and/or arrangements.

Figure 2:
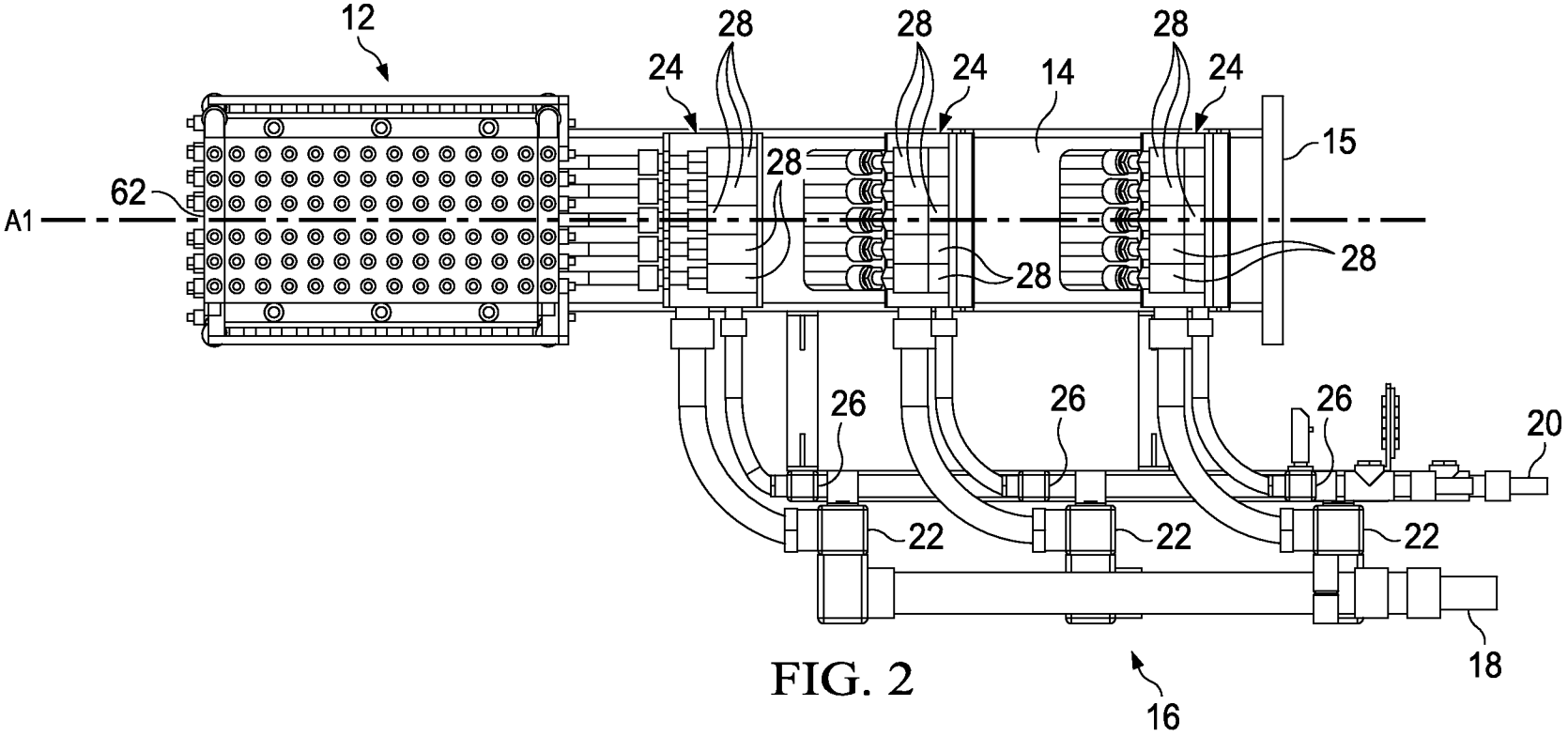
FIG. 2 is a side perspective view of the automated sprayer assembly of FIG. 1.

Referring now to FIGS. 1-3, each of the first and second sub-manifolds 76, 78 can be fluidly coupled with one of the atomizers 28 such that the each atomizer 28 feeds atomized fluid to one of the zones. By feeding a group of nozzles with one atomizer (e.g., via a sub-manifold), it is possible to achieve control of the spray pattern of the sprayer head 12 without requiring a dedicated atomizer at each nozzle which can be costly to implement and difficult to maintain. In addition, since each atomizer 28 is feeding multiple nozzles instead of only one, the orifice size of each of the atomizers can be larger (e.g., improved air sweep) and thus less susceptible to clogging. Furthermore, without dedicated atomizers for each nozzle, which are oftentimes located on the platen directly behind the nozzle, the atomizers 28 can be physically spaced apart from the platen manifolds (e.g., mounted on the frame arm 14) which can ease in the repair or replacement of any defective atomizers.

Each of the atomizers 28 can be in electrical communication with a controller that is configured to selectively control operation of the atomizers 28. The controller can control each of the atomizers 28 to control the volume of atomized fluid dispensed at each of the zones. In one embodiment, the controller can control the duration of operation (e.g., duty cycle) of each atomizer 28 to control the volume of atomized fluid dispensed at each of the zones. In another embodiment, the atomizers 28 can comprise variable orifice-type atomizers 28. In such an embodiment, the controller can control the amount of fluid flowing through the atomizers 28 to control the volume of atomized fluid dispensed at each of the zones.

When the sprayer head 12 is in position to dispense atomized fluid to the die mold, each of the atomizers 28 can be independently controlled (e.g., by the controller) to tailor the fluid dispensed at each zone to certain characteristics of the die mold. For example, certain areas of the die mold can be hotter than others when the casting is removed from the die mold. The group(s) of nozzles (e.g., 56, 58) that is/are closest to the hotter areas can provide more fluid to the hotter areas to provide more uniform cooling of the die mold than can be achieved with conventional die mold sprayers. In another example, certain areas of the die mold can be susceptible to lubricant pooling. In such an example, once the sprayer head 12 has completed dispensing the lubricant to the die mold, controlled amounts of air can be fed to the group(s) of nozzles (e.g., 56, 58) closest to the pooling areas to disperse the pooled lubricant from the die mold. The castings from the die mold can accordingly be less susceptible to porosity effects or other imperfections than die moldings that are lubricated/cooled with conventional die mold sprayers. In another example, the spray pattern of the sprayer head 12 can be tailored to conform to a variety of different die molds by selectively activating or deactivating certain groups of the nozzles (e.g., 56, 58) for a spraying process. As such the sprayer head 12 can be more versatile and thus more cost effective to implement than conventional, die-specific sprayer heads.

In one embodiment, the operational settings of the sprayer assembly 10 can be predefined for a particular die mold. In such an embodiment, the settings for the sprayer assembly 10 can be loaded into the controller prior to operation of the sprayer assembly 10 such that the sprayer head 12 operates in substantially the same manner each time the fluid is dispensed to the die mold. In another embodiment, the sprayer assembly 10 can measure/detect certain characteristics of the die mold during each operation of the sprayer assembly 10 and can tailor the operation of the sprayer head 12 to enhance the effectiveness of the fluid being dispensed for each operation of the sprayer assembly 10. In such an embodiment, the operation of each of the zones can change in response to certain characteristics of the die mold. For example, the sprayer assembly 10 can be configured to detect hot spots on the die mold from a thermal image. The sprayer assembly 10 can then direct the dispensation of fluid towards the hot spots. As the lubricant cools the die mold, the sprayer assembly 10 can continue to monitor the thermal image of the die mold and adjust the operation of the sprayer head 12 accordingly. In another example, the sprayer assembly 10 can be configured to detect pooled lubricant on the die mold and can direct the dispensation of air towards the pooled lubricant. In one embodiment, a thermal imaging device can be associated with the sprayer assembly 10 to facilitate thermal imaging of the die mold. When the casting is removed from the die mold, the thermal imaging device can detect hot spots on the die mold. Data from the thermal imaging device can be fed-back (e.g., thru a PLC) to tailor the spray pattern of the sprayer head 12 accordingly. In one embodiment, the thermal imaging device can be mounted to the die mold and positioned to image the die mold once the casting is removed. In another embodiment, the thermal imaging device can be mounted on a robotic arm that facilitates movement of the thermal imaging device into the die mold once the casting has been removed.

Figure 7:
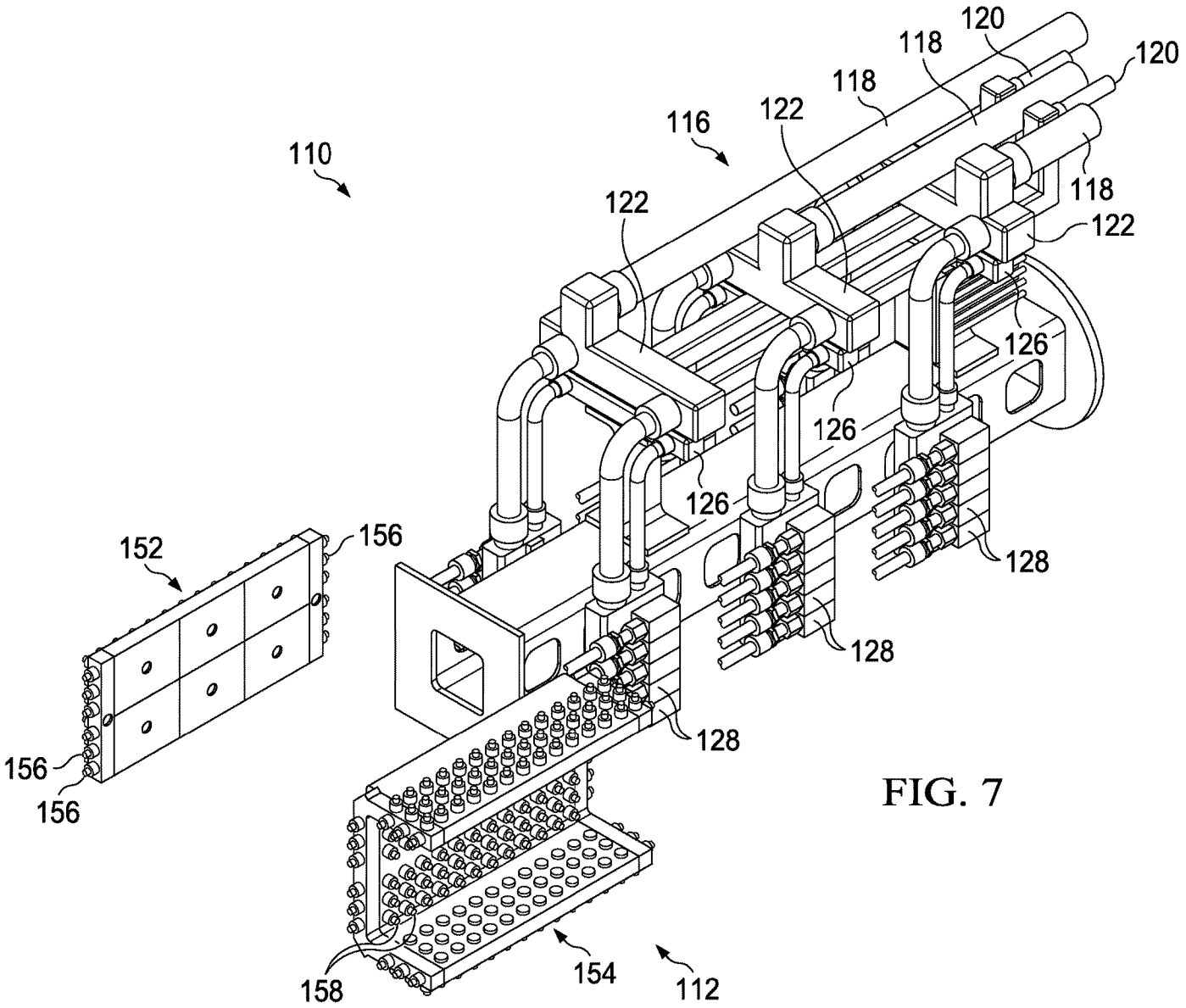
FIG. 7 is a right front perspective view depicting an automated sprayer assembly having a sprayer head in accordance with another embodiment.
Figure 8:
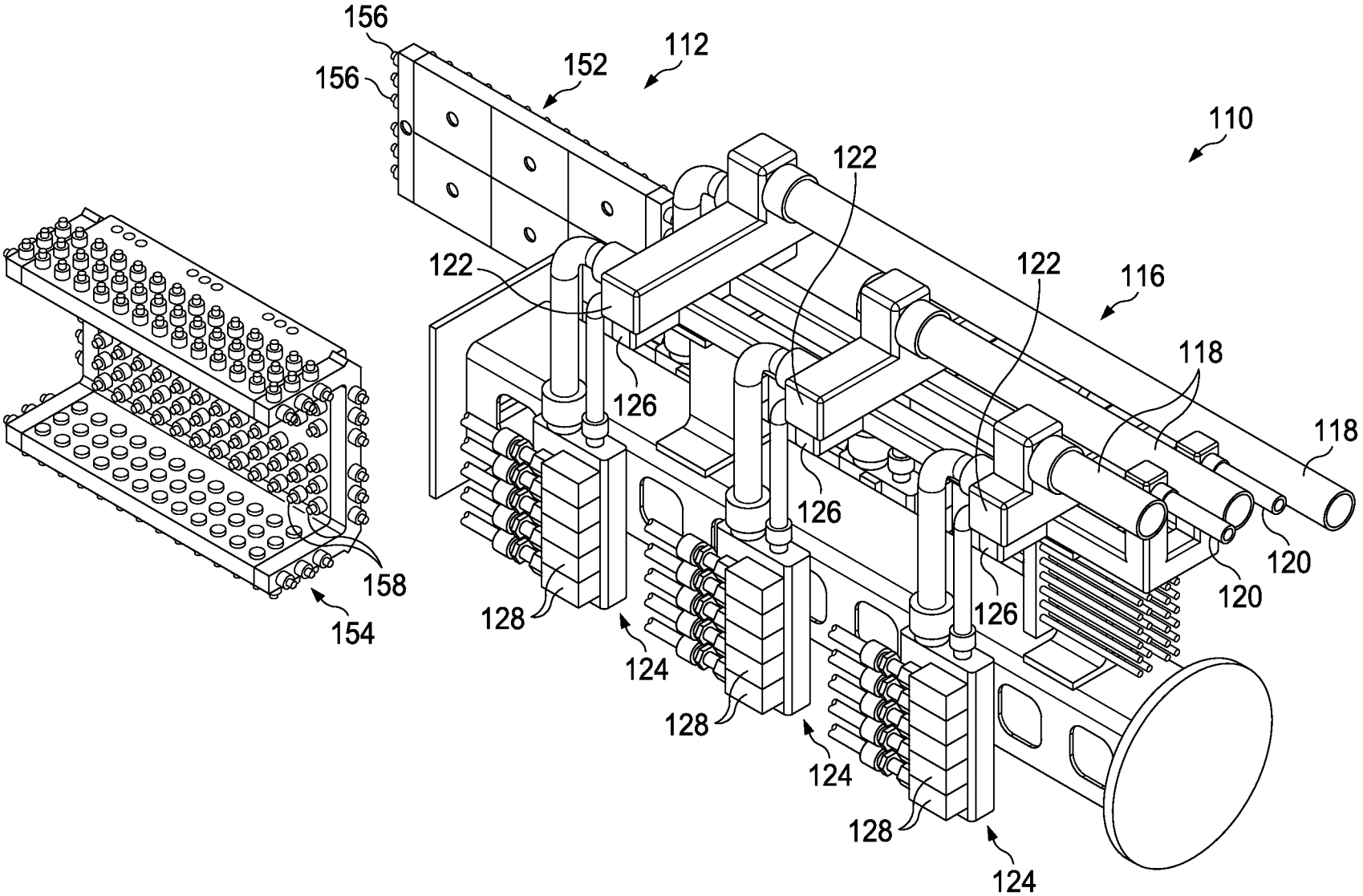
FIG. 8 is a right rear perspective view of the automated sprayer assembly of FIG. 7.
Figure 9A:
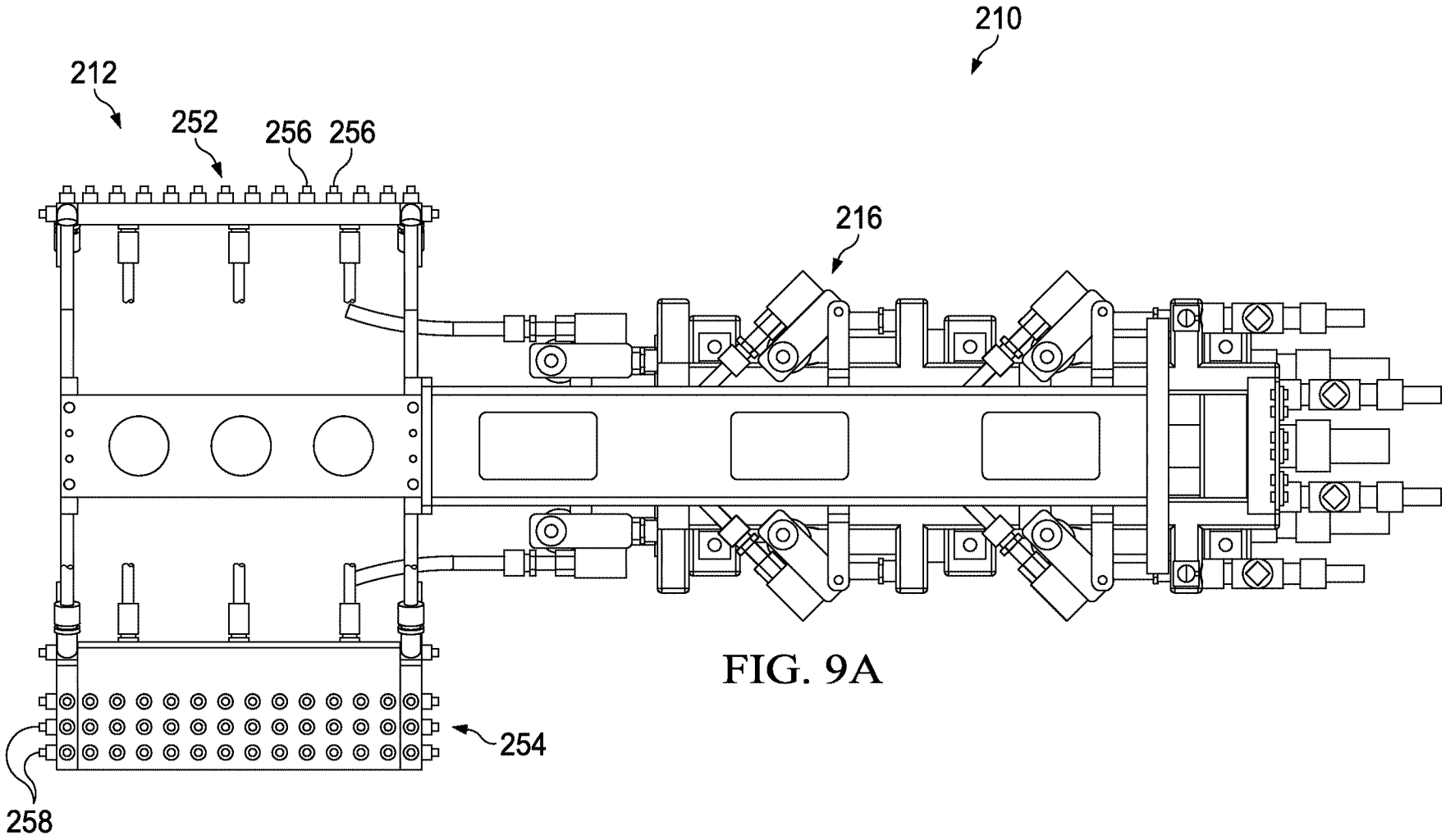
FIGS. 9A-9D are perspective views depicting an automated sprayer assembly having a sprayer head in accordance with yet another embodiment.
Figure 9B:
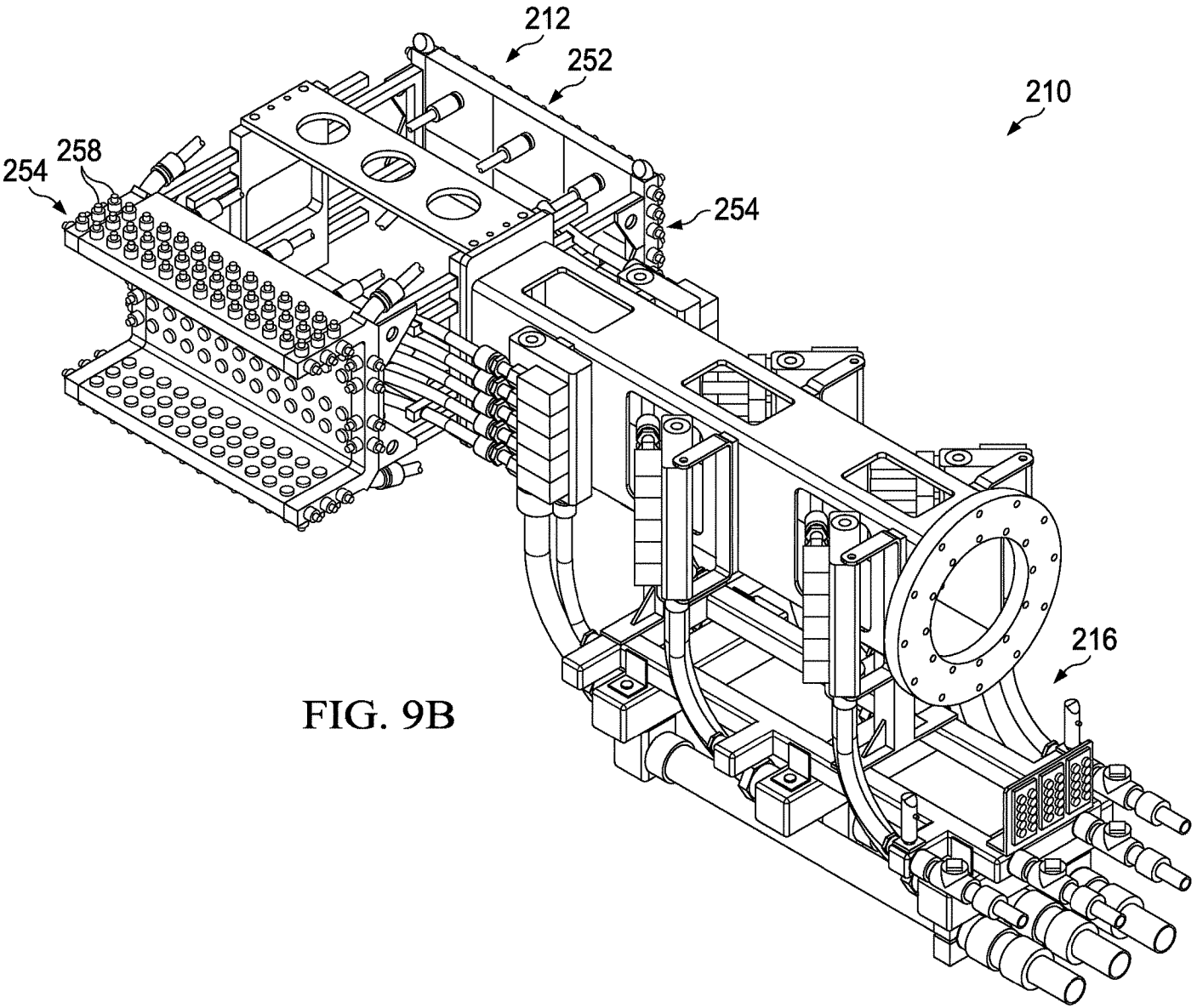
Figure 9C:
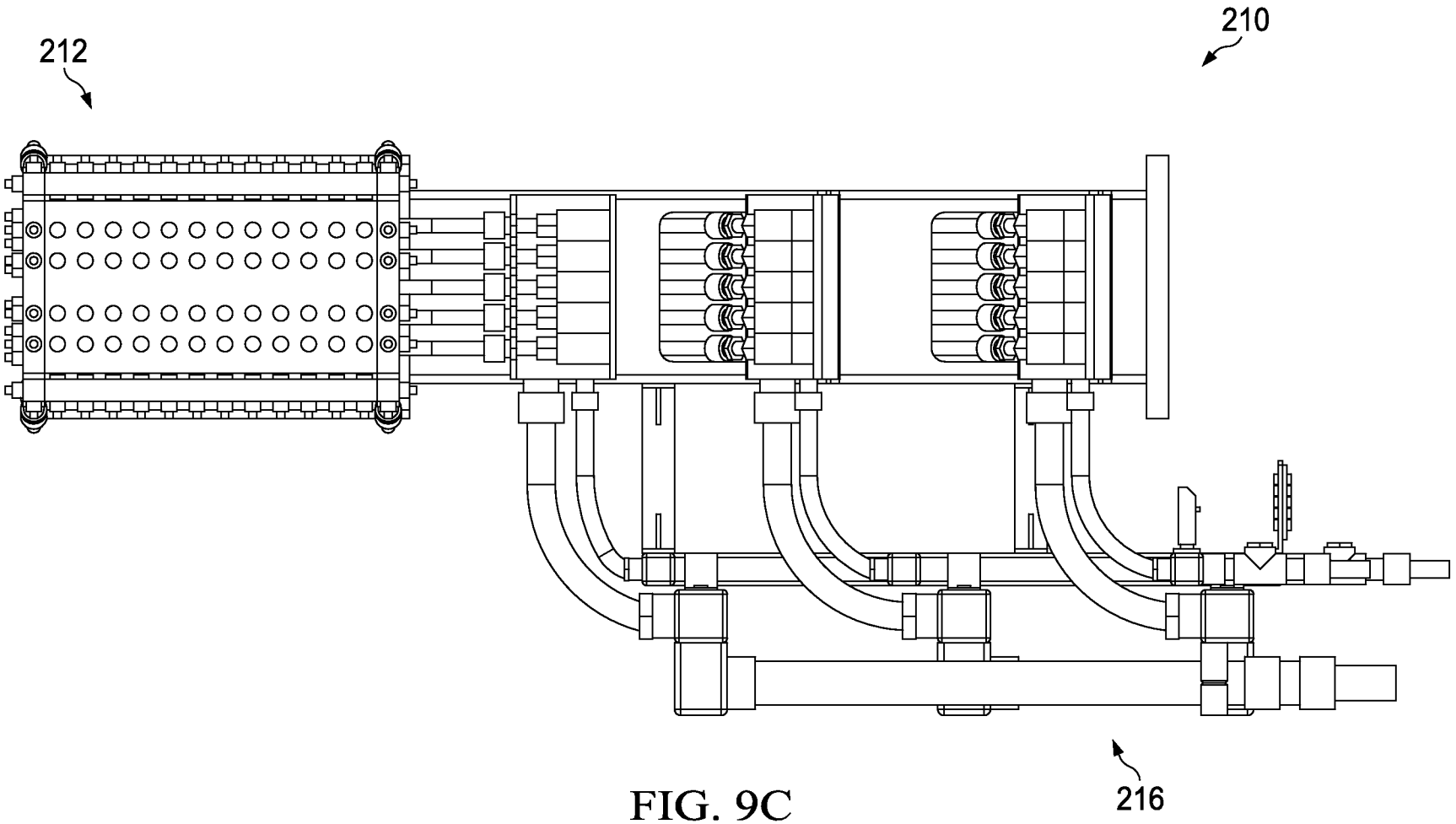
Figure 9D:
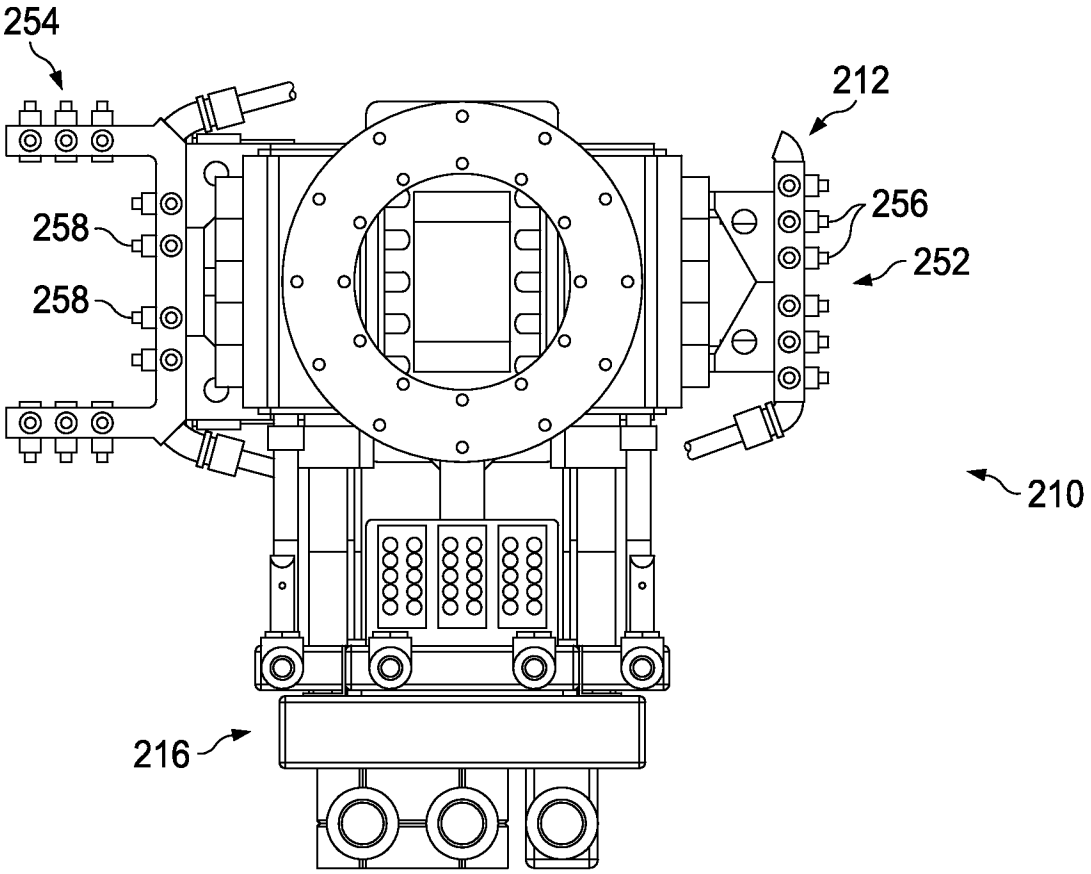

Referring now to FIGS. 7-8, a sprayer assembly 110 is illustrated according to another embodiment. The sprayer assembly 110 can be similar to, or the same in many respects as, the sprayer assembly 10 shown in FIGS. 1-6. For example, the sprayer assembly 110 can include a fluid delivery system 116 fluidly coupled with a sprayer head 112. The fluid delivery system 116 can include a plurality of air supply conduits 118 and a plurality of fluid supply conduits 120. The air supply conduits 118 can be fluidly coupled with respective air splitters 122. The fluid supply conduits 120 can be fluidly coupled with respective fluid splitters 126. The sprayer assembly 110 can include atomizer manifolds 124 having a plurality of atomizers 128. The sprayer head 112 can include first and second platen manifolds 152, 154 each having a plurality of first nozzles 156 and a plurality of second nozzles 158, respectively.

Referring now to FIGS. 9A-9D, a sprayer assembly 210 is illustrated according to another embodiment. The sprayer assembly 210 can be similar to, or the same in many respects as, the sprayer assembly 10 shown in FIGS. 1-6. For example, the sprayer assembly 210 can include a fluid delivery system 216 fluidly coupled with a sprayer head 212. The sprayer head 212 can include first and second platen manifolds 252, 254 each having a plurality of first nozzles 256 and a plurality of second nozzles 258, respectively. The first and second platen manifolds 252, 254 however can be provided on opposite sides of the sprayer head 212 as compared to the sprayer assembly 10 of FIGS. 1-7.

Figure 10A:
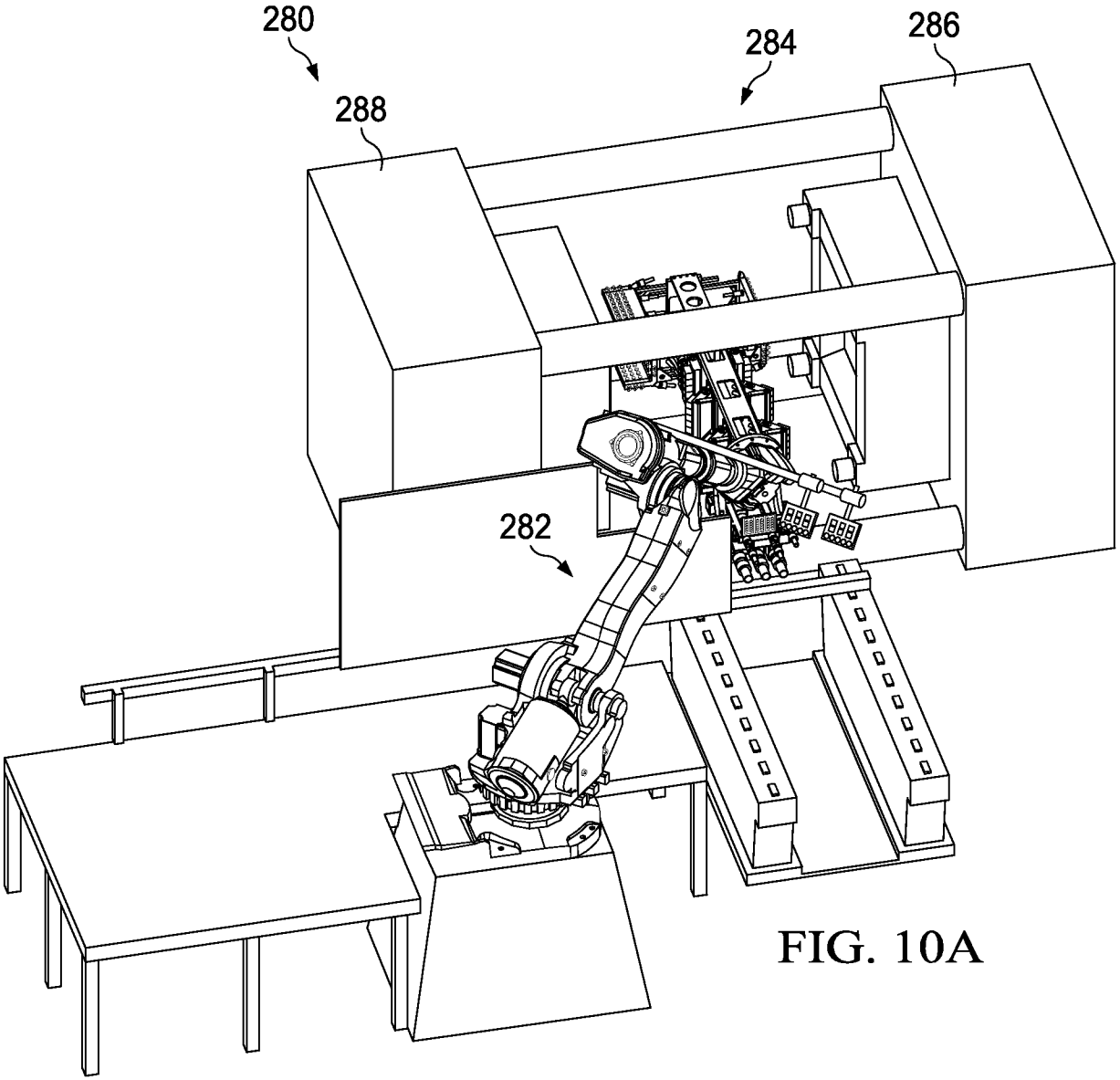
FIGS. 10A-10D are perspective views depicting the sprayer assembly of FIGS. 9A-9D associated with an automated control system that includes a robotic arm in accordance with one embodiment.
Figure 10B:
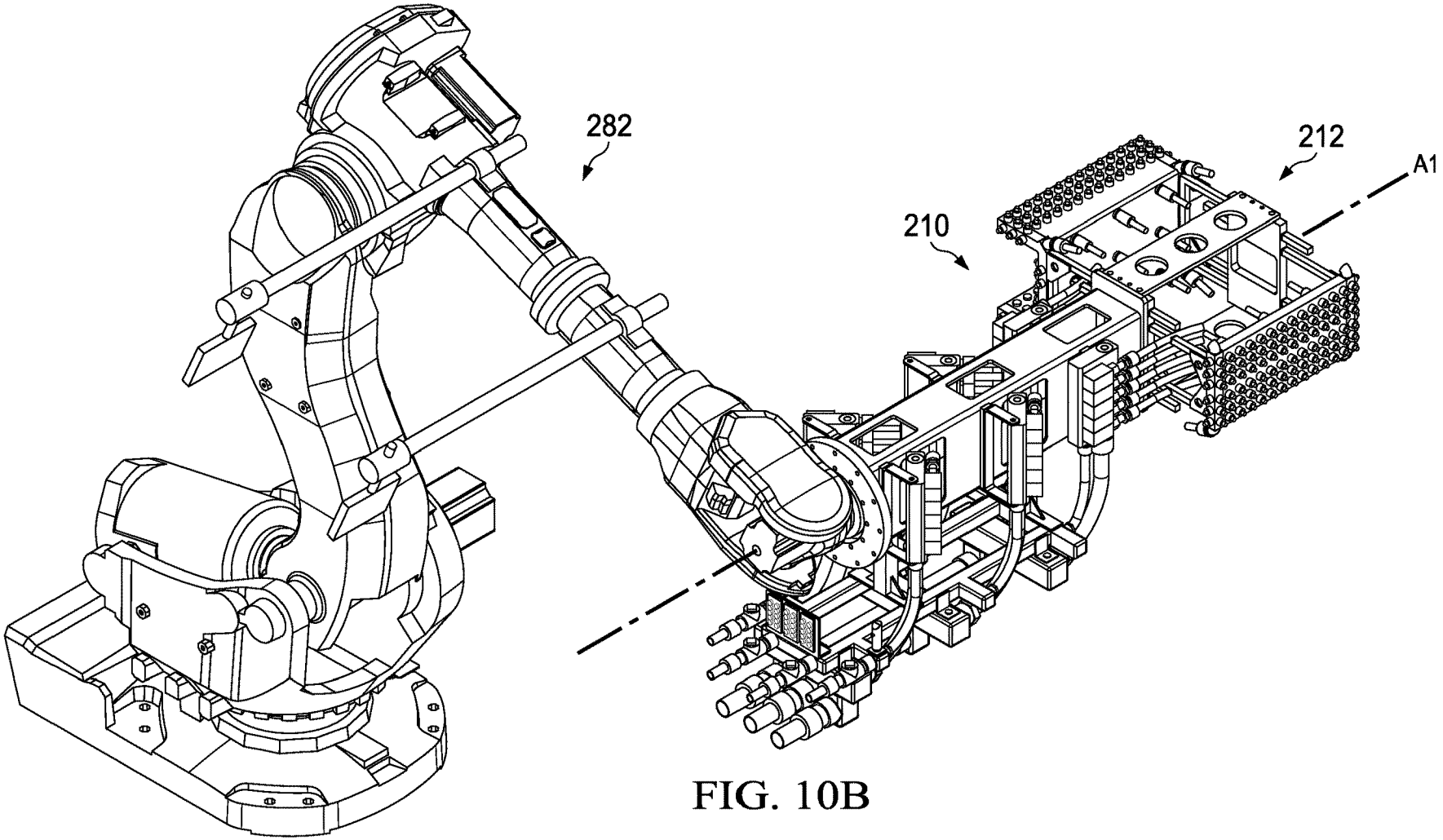
Figure 10C:
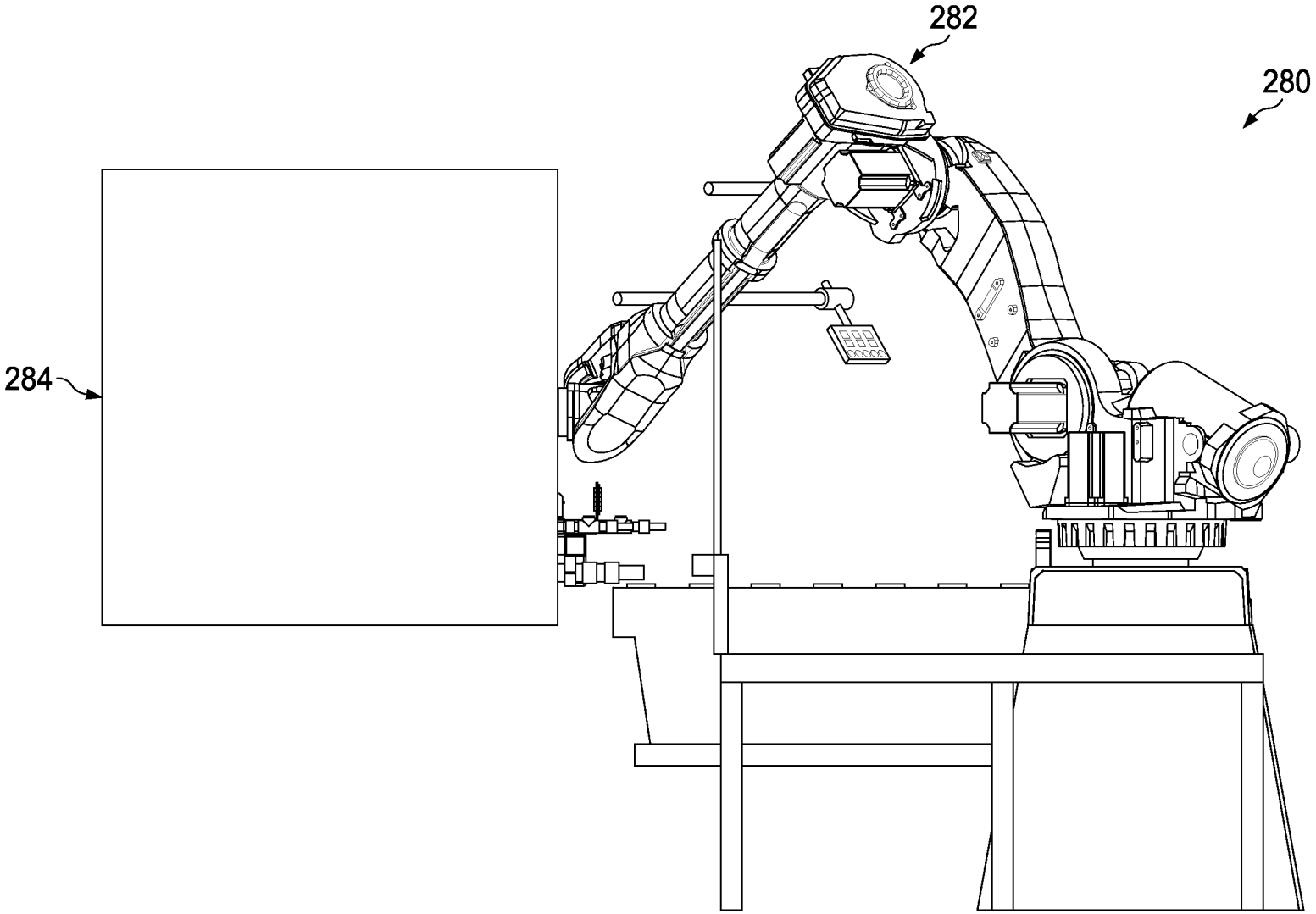
Figure 10D:
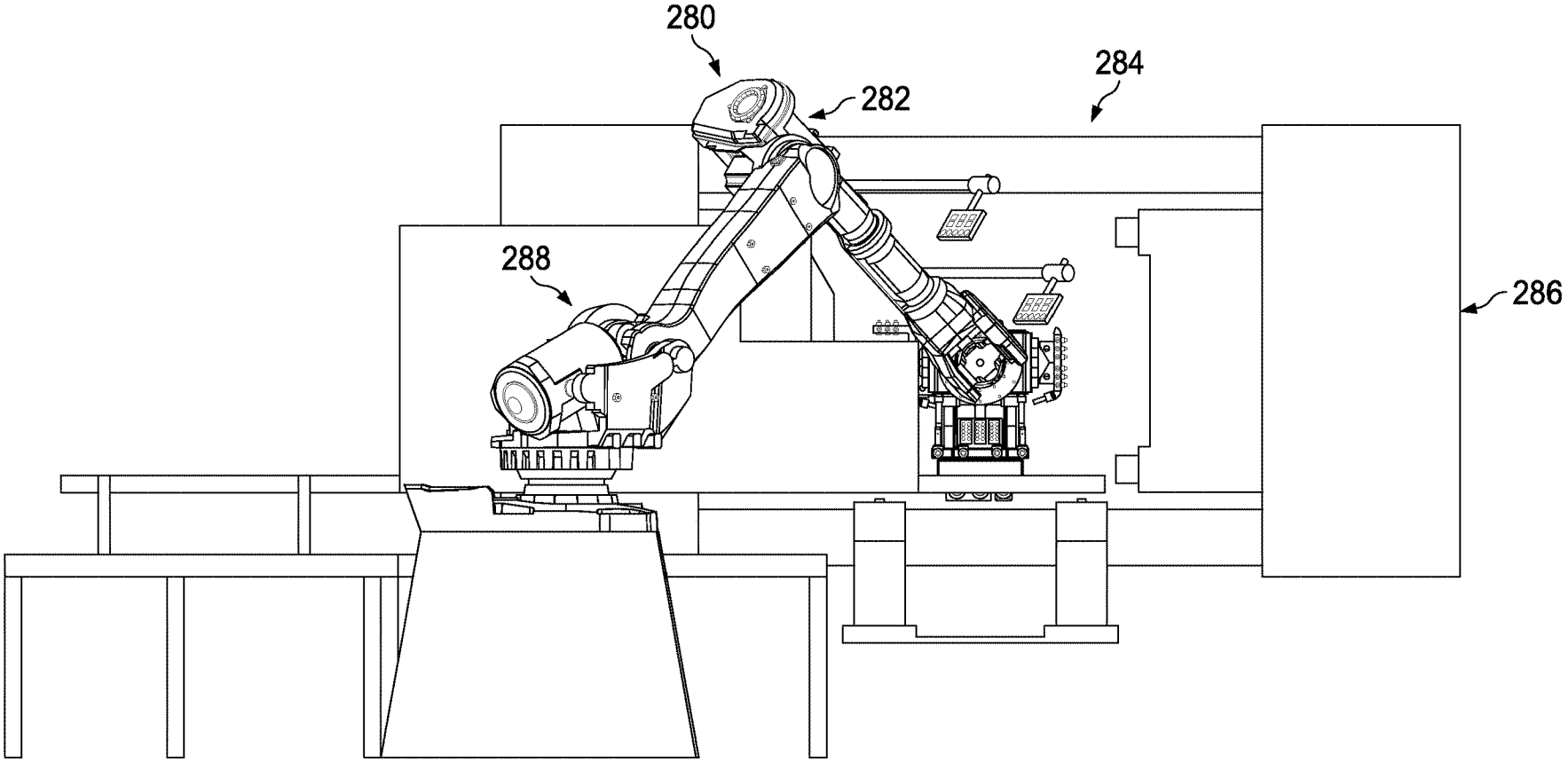
Figure 10F:
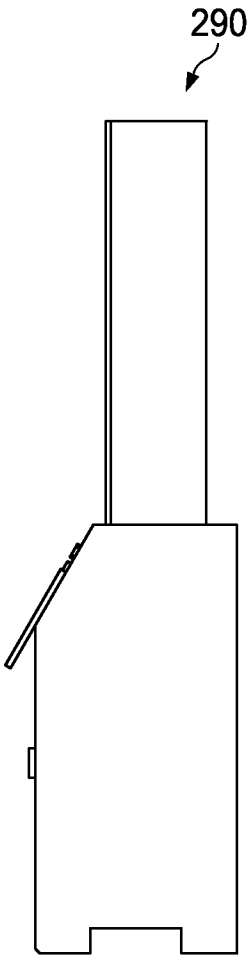
FIGS. 10E and 10F are perspective views depicting a controller of the automated control system of FIGS. 10A-10D.
Figure 10E:
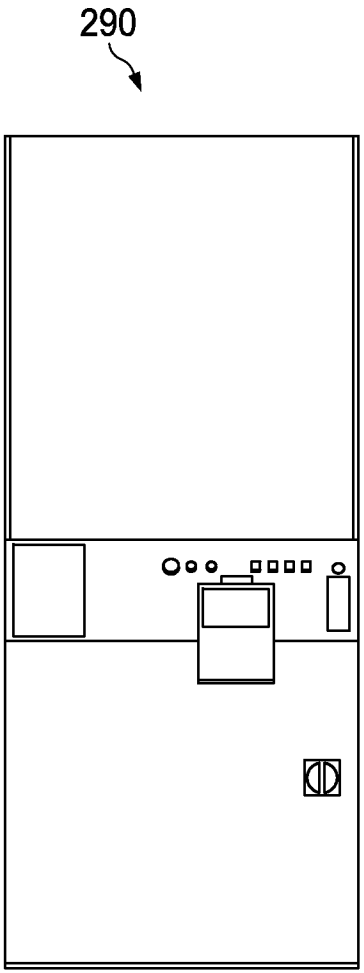

Referring now to FIGS. 10A-10F, an automated control system 280 can include a robotic arm 282 that is coupled with the sprayer assembly 210 and facilitates movement of the sprayer head 212 relative to a die mold 284. The die mold 284 is shown to include a lid portion 286 and a base portion 288. In one embodiment, the lid portion 286 can be fixed and the base portion 288 can move relative to the lid portion 286. In another embodiment, the base portion 288 and the lid portion 286 can move relative to each other. The automated control system 280 can include a controller 290, as illustrated in FIGS. 10E and 10F, that can be electrically coupled with, and can facilitate automated operation of, the sprayer assembly 210 and the robotic arm 282.

Figure 11:
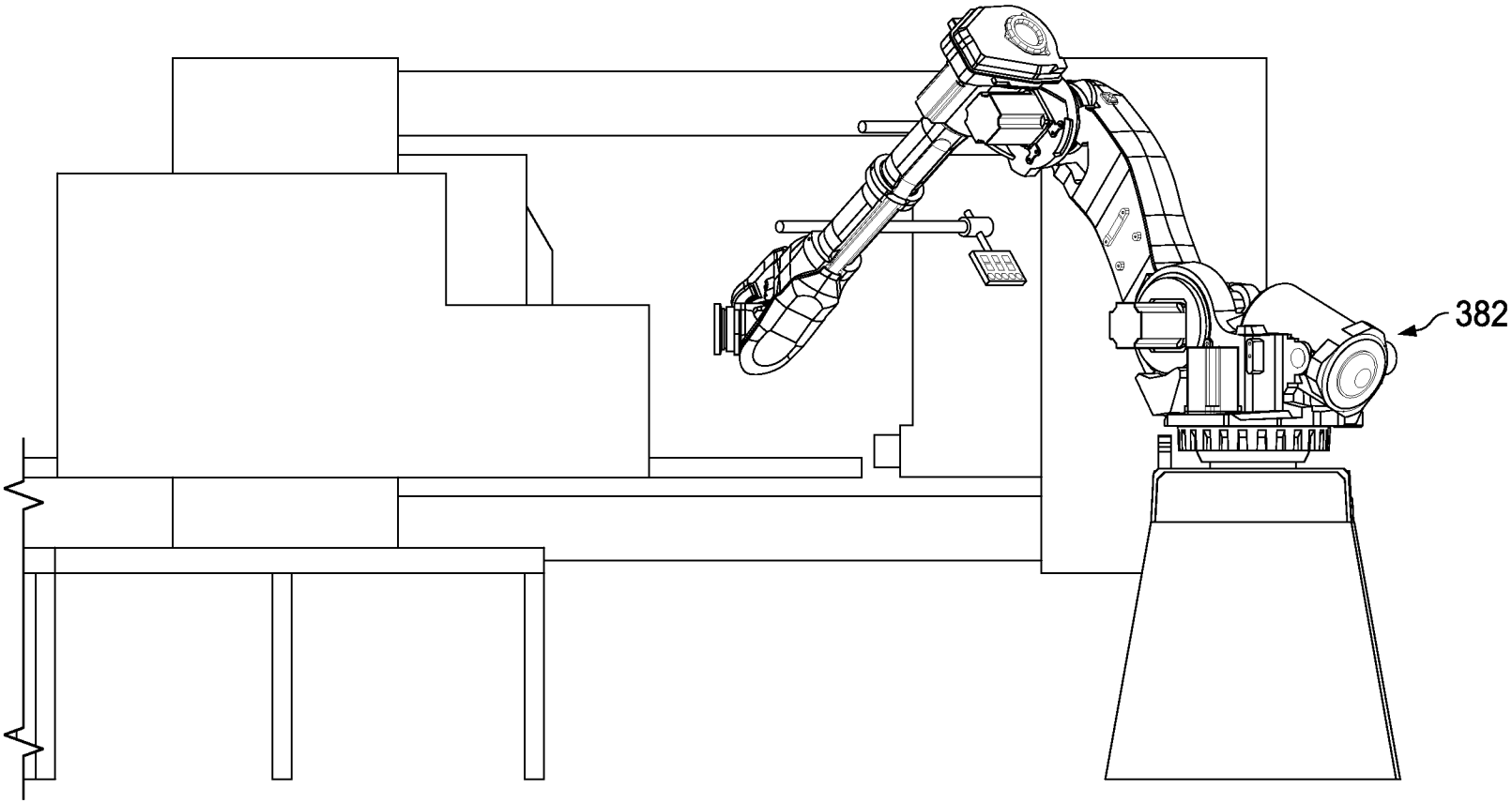
FIG. 11 is a perspective view depicting a robotic arm in accordance with another embodiment.

In one embodiment, the robotic arm 282 can facilitate operation of the sprayer assembly 210 in two directions along the longitudinal axis A1 (FIG. 10B). In another embodiment, the robotic arm 282 can facilitate operation of a sprayer assembly 210 in three mutually orthogonal directions. In such an embodiment, the robotic arm 282 can move the sprayer assembly 210 in a manner that provides more effective fluid dispensation to a die mold than can be achieved with conventional arrangements. As a result, the sprayer assembly can be utilized for a variety of different die mold applications which can increase the effectiveness of the sprayer assembly for different die mold platforms. FIG. 11 illustrates a robotic arm 382 according to another embodiment.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art.

What is claimed is:

1. A sprayer assembly comprising:

a sprayer head comprising:

a platen manifold comprising a substantially planar member having at least one planar surface comprising an outer surface and two opposing end surfaces; and a plurality of nozzles fluidly coupled with the platen manifold;

an atomizer manifold;

a fluid conduit fluidly coupled with the atomizer manifold and configured to supply fluid to the atomizer manifold;

an air conduit fluidly coupled with the atomizer manifold and configured to supply air to the atomizer manifold to atomize the fluid within the atomizer manifold; and a plurality of atomizers fluidly coupled with the atomizer manifold and the platen manifold;

wherein the fluid conduit is a common fluid conduit coupled to the plurality of atomizers to supply fluid to each of the plurality of atomizers, wherein each atomizer is fluidly coupled to a corresponding subset of the plurality of nozzles and upstream from the plurality of nozzles such that each atomizer feeds atomized fluid to the corresponding subset of the plurality of nozzles for dispensation of the atomized fluid from the plurality of nozzles, and wherein the plurality of nozzles are coupled to each of the outer surface and the two opposing end surfaces such that the platen manifold facilitates distribution of atomized fluid in three substantially different directions.

2. The sprayer assembly of claim 1 wherein:

the plurality of atomizers comprises a first atomizer and a second atomizer;

the platen manifold comprises a first submanifold and a second submanifold fluidly coupled with the first atomizer and the second atomizer, respectively; and the plurality of nozzles comprises a first group of nozzles and a second group of nozzles fluidly coupled with the first submanifold and the second submanifold, respectively;

wherein the first atomizer and the second atomizer are configured to feed atomized fluid to the first submanifold and the second submanifold, respectively, for dispensation of the atomized fluid from the first group of nozzles and the second group of nozzles, respectively.

3. The sprayer assembly of claim 2 wherein the first group of nozzles defines a first spray zone, the second group of nozzles defines a second spray zone, and the first spray zone and the second spray zone are different.

4. The sprayer assembly of claim 3 wherein each of the first group of nozzles and the second group of nozzles comprises between about 6 and about 9 nozzles.

5. The sprayer assembly of claim 1 further comprising a controller in electrical communication with the plurality of atomizers and configured to facilitate independent control of each atomizer of the plurality of atomizers.

6. The sprayer assembly of claim 5 wherein the controller is configured to control at least one of a duration of operation and an orifice size of each atomizer to control the volume of atomized fluid dispensed from each atomizer.

7. The sprayer assembly of claim 1 further comprising a fluid delivery system fluidly coupled with the sprayer head and configured to feed fluid to the sprayer head for dispensation of atomized fluid from the plurality of nozzles.

8. The sprayer assembly of claim 7 wherein the fluid delivery system comprises:

a fluid valve network fluidly coupled with the fluid conduit and configured to facilitate selective distribution of different types of fluid or combinations thereof to the sprayer head; and an air valve network fluidly coupled with the air conduit and configured to facilitate selective distribution of air to the atomizer manifold.

9. A sprayer assembly comprising:

a sprayer head comprising:

a substantially C-shaped platen manifold having at least one planar surface comprising an upper exterior surface, a lower exterior surface, an upper interior surface, a lower interior surface, a central interior surface, and two opposing end surfaces; and a plurality of nozzles fluidly coupled with the platen manifold;

an atomizer manifold;

a fluid conduit fluidly coupled with the atomizer manifold and configured to supply fluid to the atomizer manifold;

an air conduit fluidly coupled with the atomizer manifold and configured to supply air to the atomizer manifold to atomize the fluid within the atomizer manifold; and a plurality of atomizers fluidly coupled with the atomizer manifold and the platen manifold;

wherein the fluid conduit is a common fluid conduit coupled to the plurality of atomizers to supply fluid to each of the plurality of atomizers, wherein each atomizer is fluidly coupled to a corresponding subset of the plurality of nozzles and upstream from the plurality of nozzles such that each atomizer feeds atomized fluid to the corresponding subset of the plurality of nozzles for dispensation of the atomized fluid from the plurality of nozzles, and wherein the plurality of nozzles are coupled to each of the upper exterior surface, the lower exterior surface, the upper interior surface, the lower interior surface, the central interior surface, and the two opposing end surfaces such that the platen manifold facilitates distribution of atomized fluid in four substantially different exterior directions and three substantially different interior directions.

10. The sprayer assembly of claim 9 wherein:

the plurality of atomizers comprises a first atomizer and a second atomizer;

the platen manifold comprises a first submanifold and a second submanifold fluidly coupled with the first atomizer and the second atomizer, respectively; and the plurality of nozzles comprises a first group of nozzles and a second group of nozzles fluidly coupled with the first submanifold and the second submanifold, respectively;

wherein the first atomizer and the second atomizer are configured to feed atomized fluid to the first submanifold and the second submanifold, respectively, for dispensation of the atomized fluid from the first group of nozzles and the second group of nozzles, respectively.

11. The sprayer assembly of claim 10 wherein the first group of nozzles defines a first spray zone, the second group of nozzles defines a second spray zone, and the first spray zone and the second spray zone are different.

12. The sprayer assembly of claim 11 wherein each of the first group of nozzles and the second group of nozzles comprises between about 6 and about 9 nozzles.

13. The sprayer assembly of claim 9 further comprising a controller in electrical communication with the plurality of atomizers and configured to facilitate independent control of each atomizer of the plurality of atomizers.

14. The sprayer assembly of claim 13 wherein the controller is configured to control at least one of a duration of operation and an orifice size of each atomizer to control the volume of atomized fluid dispensed from each atomizer.

15. A sprayer assembly comprising:

a sprayer head comprising:

a first platen manifold comprising a substantially planar member including a first submanifold having at least one first planar surface comprising an outer surface and a second submanifold having at least one second planar surface comprising two opposing end surfaces;

a second platen manifold comprising a third submanifold having at least one third planar surface and a fourth submanifold having at least one fourth planar surface;

a first group of nozzles fluidly coupled with the first submanifold and coupled to the outer surface;

a second group of nozzles fluidly coupled with the second submanifold and coupled to the two opposing end surfaces such that the first platen manifold facilitates distribution of atomized fluid in three substantially different directions;

a third group of nozzles fluidly coupled with the third submanifold and coupled to the at least one third planar surface; and a fourth group of nozzles fluidly coupled with the fourth submanifold and coupled to the at least one fourth planar surface;

a first atomizer manifold;

a second atomizer manifold;

a first fluid conduit fluidly coupled with the first atomizer manifold and configured to supply fluid to the first atomizer manifold;

a second fluid conduit fluidly coupled with the second atomizer manifold and configured to supply fluid to the second atomizer manifold;

a first air conduit fluidly coupled with the first atomizer manifold and configured to supply air to atomize the fluid within the first atomizer manifold;

a second air conduit fluidly coupled with the second atomizer manifold and configured to supply air to atomize the fluid within the second atomizer manifold; and a first atomizer fluidly coupled with the first atomizer manifold and the first submanifold, and upstream from the first group of nozzles, the first atomizer being configured to feed atomized fluid to the first submanifold for dispensation from the first group of nozzles;

a second atomizer fluidly coupled with the first atomizer manifold and the second submanifold, and upstream from the second group of nozzles, the second atomizer being configured to feed atomized fluid to the second submanifold for dispensation from the second group of nozzles;

a third atomizer fluidly coupled with the second atomizer manifold and the third submanifold, and upstream from the third group of nozzles, the third atomizer being configured to feed atomized fluid to the third submanifold for dispensation from the third group of nozzles; and a fourth atomizer fluidly coupled with the second atomizer manifold and the fourth submanifold, and upstream from the fourth group of nozzles, the fourth atomizer being configured to feed atomized fluid to the fourth submanifold for dispensation from the fourth group of nozzles, wherein the first fluid conduit is a first common fluid conduit coupled to the first atomizer and the second atomizer to supply fluid to the first atomizer and the second atomizer, and wherein the second fluid conduit is a second common fluid conduit coupled to the third atomizer and the fourth atomizer to supply fluid to the third atomizer and the fourth atomizer.

16. The sprayer assembly of claim 15 wherein the first platen manifold and the second platen manifold are provided on opposite sides of the sprayer head.

17. The sprayer assembly of claim 15 wherein at least one of the first atomizer, the second atomizer, the third atomizer, and the fourth atomizer is physically, spaced apart from at least one of the first submanifold, the second submanifold, the third submanifold, and the fourth submanifold, respectively.

18. The sprayer assembly of claim 15 further comprising:

a first fluid source coupled with the first fluid conduit and configured to distribute a first fluid to the first fluid conduit for distribution from the first platen manifold; and a second fluid source coupled with the second fluid conduit and configured to distribute a second fluid to the second fluid conduit for distribution from the second platen manifold;

wherein the first fluid and the second fluid are different.

19. The sprayer assembly of claim 18 wherein the first fluid and the second fluid each comprise differing ones of a lubricant, an anti-solder, and water.

20. The sprayer assembly of claim 15, in combination with a robotic arm, wherein the robotic arm is configured to facilitate movement of the sprayer head relative to a die mold.

* * * * *